US006196086B1

(12) United States Patent
Gort-Barten

(10) Patent No.: US 6,196,086 B1
(45) Date of Patent: Mar. 6, 2001

(54) FOIL CUTTER FOR A CORKSCREW

(75) Inventor: Leslie Alexander Gort-Barten, London (GB)

(73) Assignee: Dual Limited, London (GB)

( * ) Notice: Subject to any disclaimer, the term of this patent is extended or adjusted under 35 U.S.C. 154(b) by 0 days.

(21) Appl. No.: 09/367,477

(22) PCT Filed: Feb. 10, 1998

(86) PCT No.: PCT/GB98/00412

§ 371 Date: Oct. 15, 1999

§ 102(e) Date: Oct. 15, 1999

(87) PCT Pub. No.: WO98/35907

PCT Pub. Date: Aug. 20, 1998

(30) Foreign Application Priority Data

Feb. 13, 1997 (GB) ..... 9702913

(51) Int. Cl.[7] ..... B67B 7/44

(52) U.S. Cl. ..... 81/3.09; 30/1.5; 7/155; 7/151

(58) Field of Search ..... 81/3.09, 3.48, 81/3.36, 3.29; 7/151, 155, 156; 30/1.5

(56) References Cited

U.S. PATENT DOCUMENTS

| | | | | |
|---|---|---|---|---|
| 2,896,317 | | 7/1959 | Vaive | 30/1.5 |
| 4,845,844 | * | 7/1989 | Allen | 30/1.5 |
| 5,351,579 | * | 10/1994 | Metz et al. | 81/3.2 |
| 5,372,054 | * | 12/1994 | Federighi, Sr. | 81/309 |
| 5,887,305 | * | 3/1999 | Cellinie | 7/155 |

FOREIGN PATENT DOCUMENTS

| | | |
|---|---|---|
| 89 13 678 U1 | 1/1990 | (DE) . |
| 39 27 261 A1 | 2/1991 | (DE) . |
| 296 09 849 U1 | 8/1996 | (DE) . |
| 2 181 985 | 5/1987 | (GB) . |

* cited by examiner

*Primary Examiner*—David A. Scherbel
*Assistant Examiner*—Hadi Shakeri
(74) *Attorney, Agent, or Firm*—Lahive & Cockfield, LLP

(57) ABSTRACT

The invention relates to a foil cutter (12) and such a cutter in combination with a corkscrew (2) and/or a crown cap opener (35). The foil cutter (12) comprises an annular casing (16, 17) having a passage (14) extending axially therethrough and adapted to accommodate the neck of a wine bottle, and a pair of cutting members (22) having cutting edges (23) mounted in the casing so that each extends or is movable to extend into the passage in a plane normal to the axis, one or more of the cutting edges (23) or a guide member (50) aligned therewith being movable relative to the casing radially inwardly of the passage so as to ensure that both cutting edges engage a bottle neck located in the passage. Preferably a push member (25) is connected to each movable member and extends to the outside of the casing for pressing the associated movable member inwardly, and biasing means (27) resists such inward movement. The corkscrew has arms (21) which are a retaining fit in the passage (14) of the foil cutter so that the foil cutter acts as a stand for the corkscrew.

12 Claims, 7 Drawing Sheets

FIG. 3
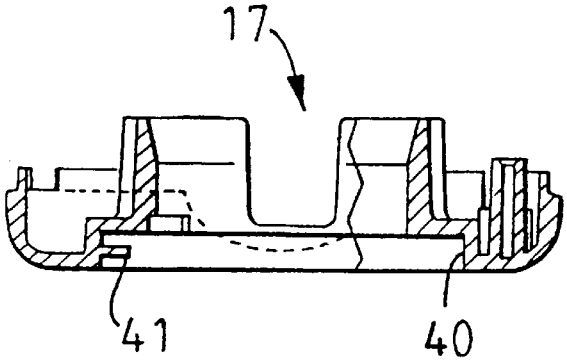
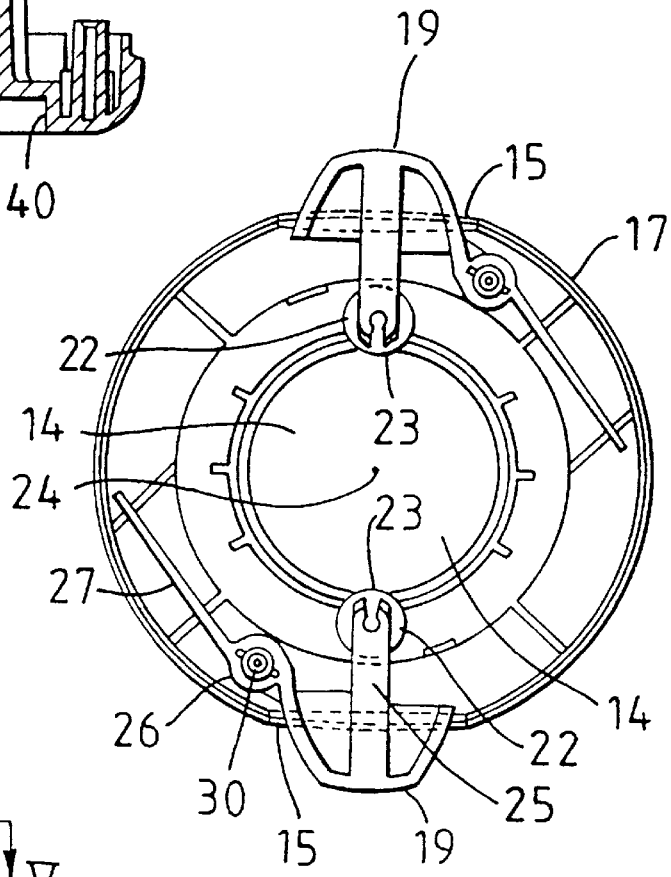
FIG. 2
FIG. 4
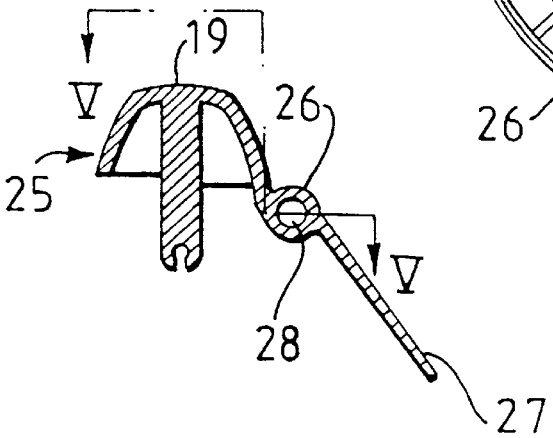
FIG. 5
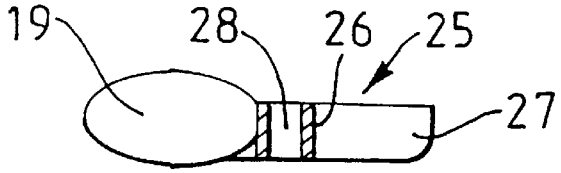

FIG. 6
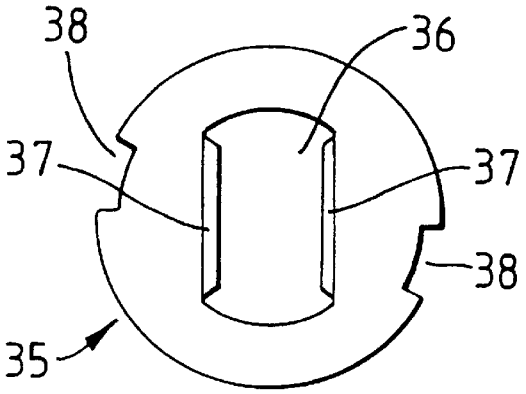
FIG. 8
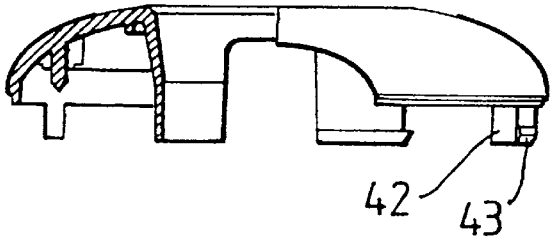
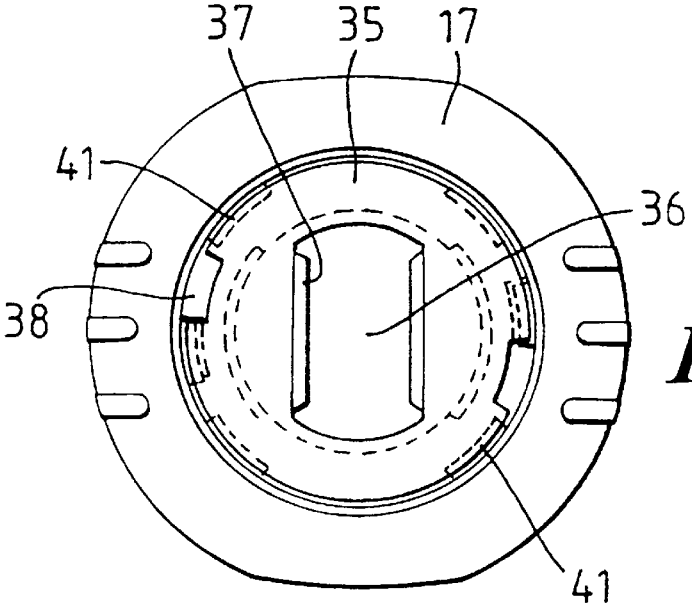
FIG. 7

FIG. 11
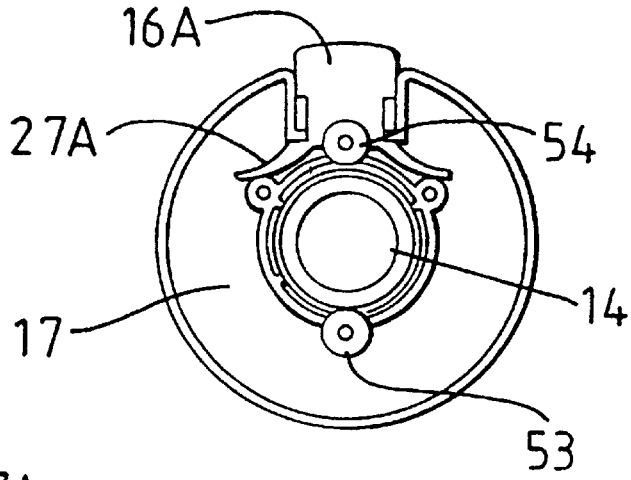
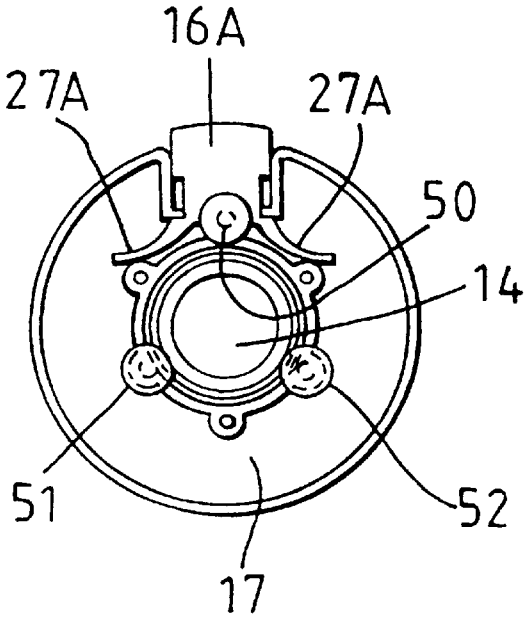
FIG. 10
FIG. 12
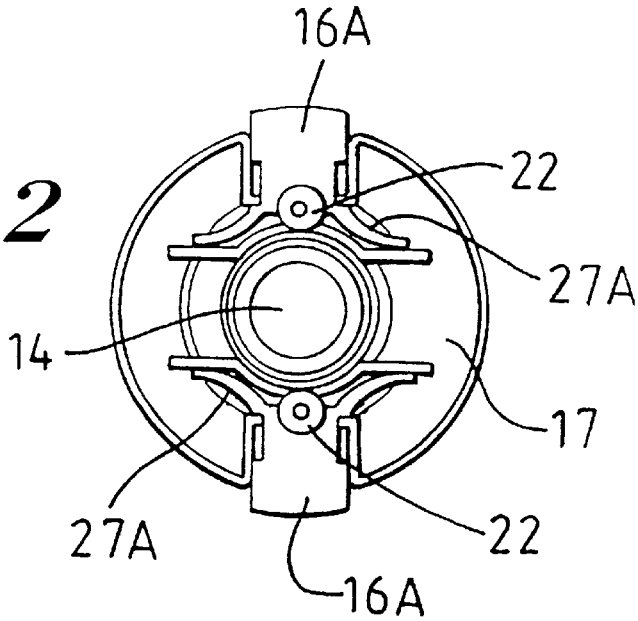

FOIL CUTTER FOR A CORKSCREW

FIELD OF INVENTION

This invention relates to a foil cutter and such a cutter in combination with a crown top opener and/or a corkscrew.

BACKGROUND OF INVENTION

A foil cutter is known, for example from EP-A-0220850, having four rotatable cutters mounted in a flexible U-shaped frame. The foil cutter is completely separate from any other bottle opening apparatus such as a self-pull extractor, for example as disclosed in EP-A-0129301.

SUMMARY OF THE INVENTION

In one aspect this invention provides a foil cutter comprising an annular casing having a passage extending axially therethrough and adapted to accommodate the neck of a wine bottle, and a pair of cutting members having cutting edges mounted in the casing so that each extends or is movable to extend into the passage in a plane normal to the axis, one or more of the cutting edges or a guide member aligned therewith being movable relative to the casing radially inwardly of the passage so as to ensure that both cutting edges engage a bottle neck located in said passage. Preferably the passage is substantially circular sectioned and each movable member is biased outwardly of the casing and is attached to a push member extending to the outside of the casing for pressing the movable member radially inwardly. The or each movable member may for example be movable to give a variation of diameter of the cutting circle including the cutting/guide edges in the range 3 to 5 mm.

In one form the cutting members in the form of wheels are mounted radially opposite one another with one fixed relative to the casing and the other movable radially inwardly. In another form each of the opposite cutting wheels is movable radially. In another form the cutting wheels and a guide member are substantially equally angularly spaced from one another and the cutting wheels are radially fixed with the guide member movable radially inwardly. Further configurations of cutting/guide wheels are clearly possible.

In the preferred form the casing forms a substantially closed outer shell apart from the opening(s) for the push member or members. In a preferred form one of the openings to the passage is shaped to define a crown cap opener or a separate crown cap opener is attached in a recess of the foil cutter. This may for example take the form of the opening being defined by a flat edge. In this form the device has a dual use as a foil cutter and crown top opener. In an alternative a foil cutter may be separate from a crown top opener but the foil cutter and crown top opener are arranged to be a retaining fit together, for example a push fit.

Preferably the base of the foil cutter or crown top opener is flat so that the casing is stable when supported on a flat surface. In another aspect the invention comprises a foil cutter or combined foil cutter and crown top opener which is arranged to form a stand for a corkscrew, the corkscrew being arranged to be a comfortable push fit in the passage of the foil cutter so that the corkscrew will be supported by and stand up from the foil cutter supported on a support surface.

BRIEF DESCRIPTION OF THE DRAWINGS

Embodiments of bottle opening apparatus, in accordance with the invention, will now be described, by way of example only, with reference to the accompanying drawings of which:

FIG. 2 is a plan view of the bottom casing part of the foil cutter assembled with cutters and push members;

FIG. 3 is a section through the bottom casing part of FIG. 2;

FIG. 4 is a sectional view of one push member of FIG. 2;

FIG. 5 is a section on the line V—V of FIG. 4;

FIG. 6 is an underneath plan view of a crown cap opener;

FIG. 7 is an underneath plan view of the bottom casing part of FIG. 2 assembled with the crown cap opener of FIG. 6;

FIG. 8 is a side view, partly sectioned, of the top casing part of the foil cutter;

FIGS. 10 to 12 are views corresponding to those of FIG. 2 but showing possible modifications.

DETAILED DESCRIPTION OF EMBODIMENTS OF THE INVENTION

Figure 1A:
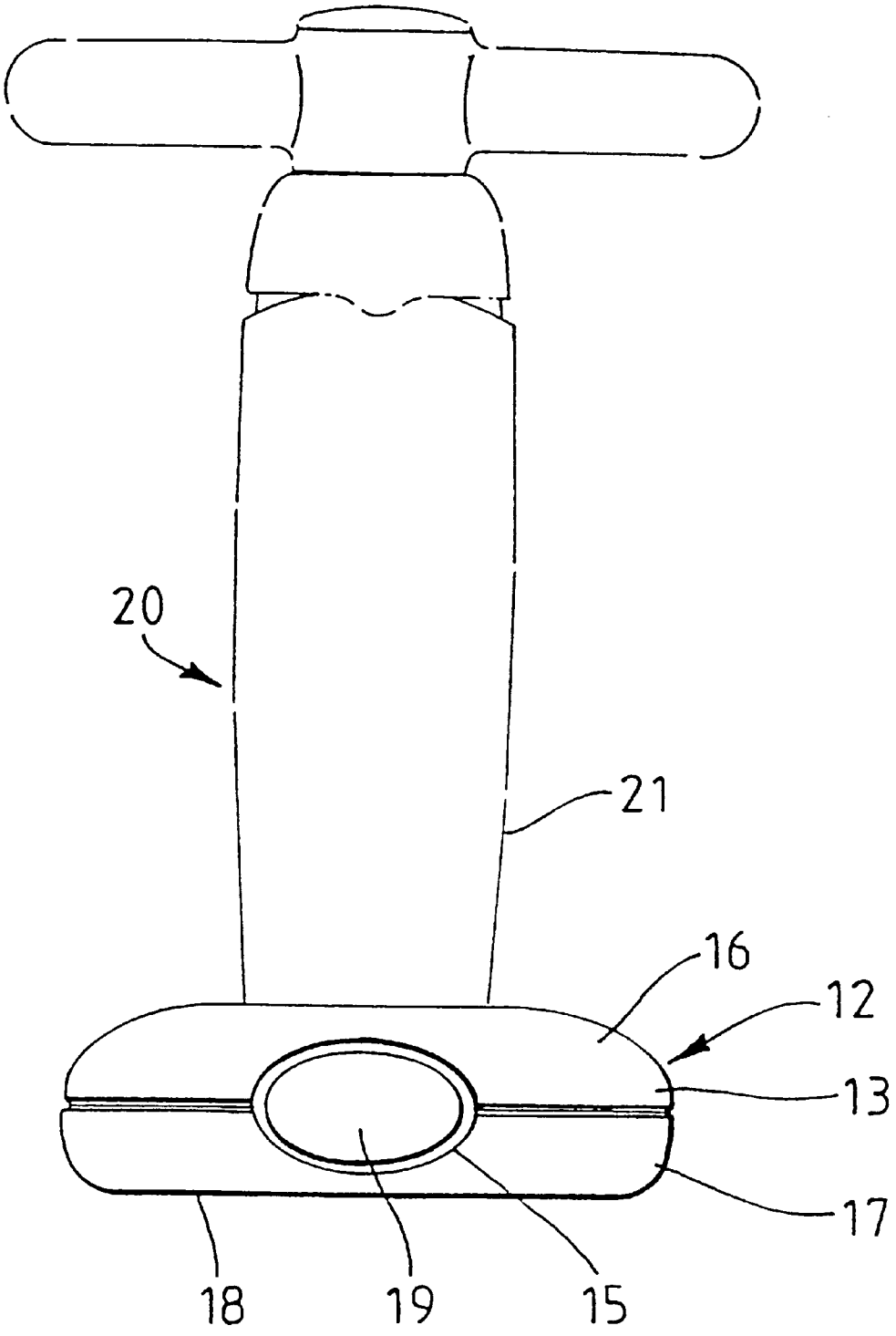
FIG. 1A is a side view of an assembled foil cutter and corkscrew assembly.
Figure 1B:
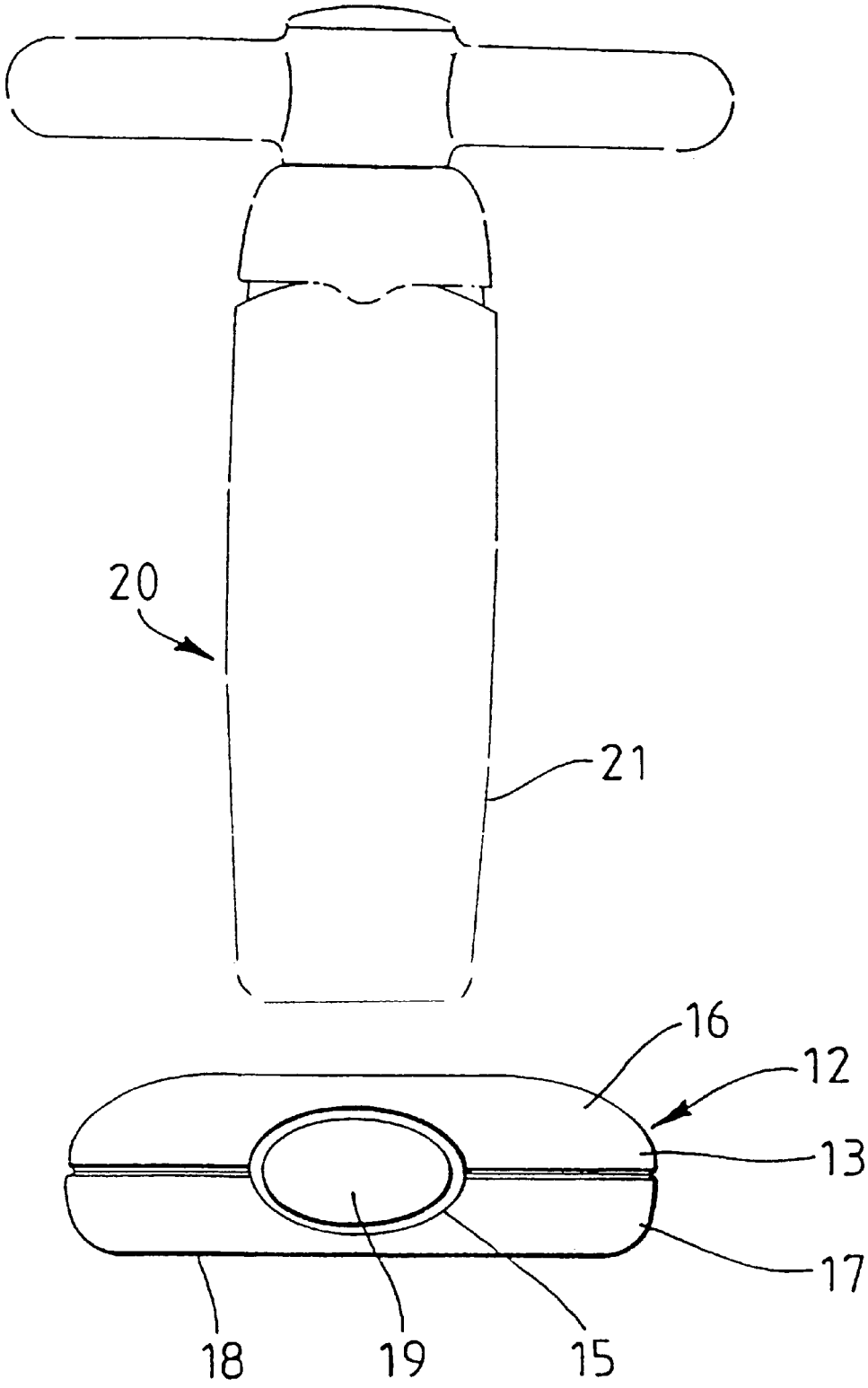
FIG. 1B is a side view of a separated foil cutter and corkscrew assembly.
Figure 1C:
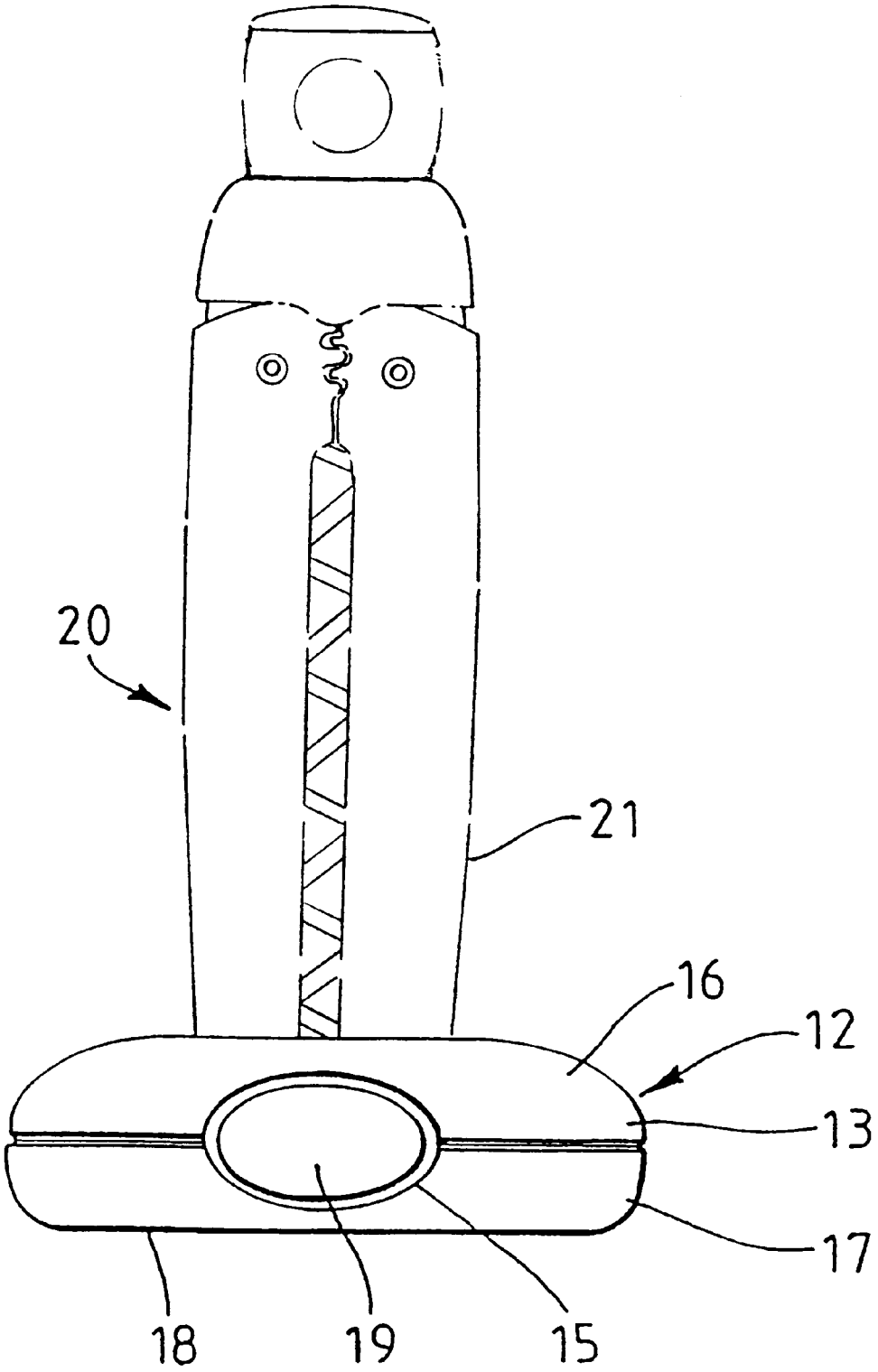
FIG. 1C is a front view of the assembly of FIG. 1.
Figure 9:
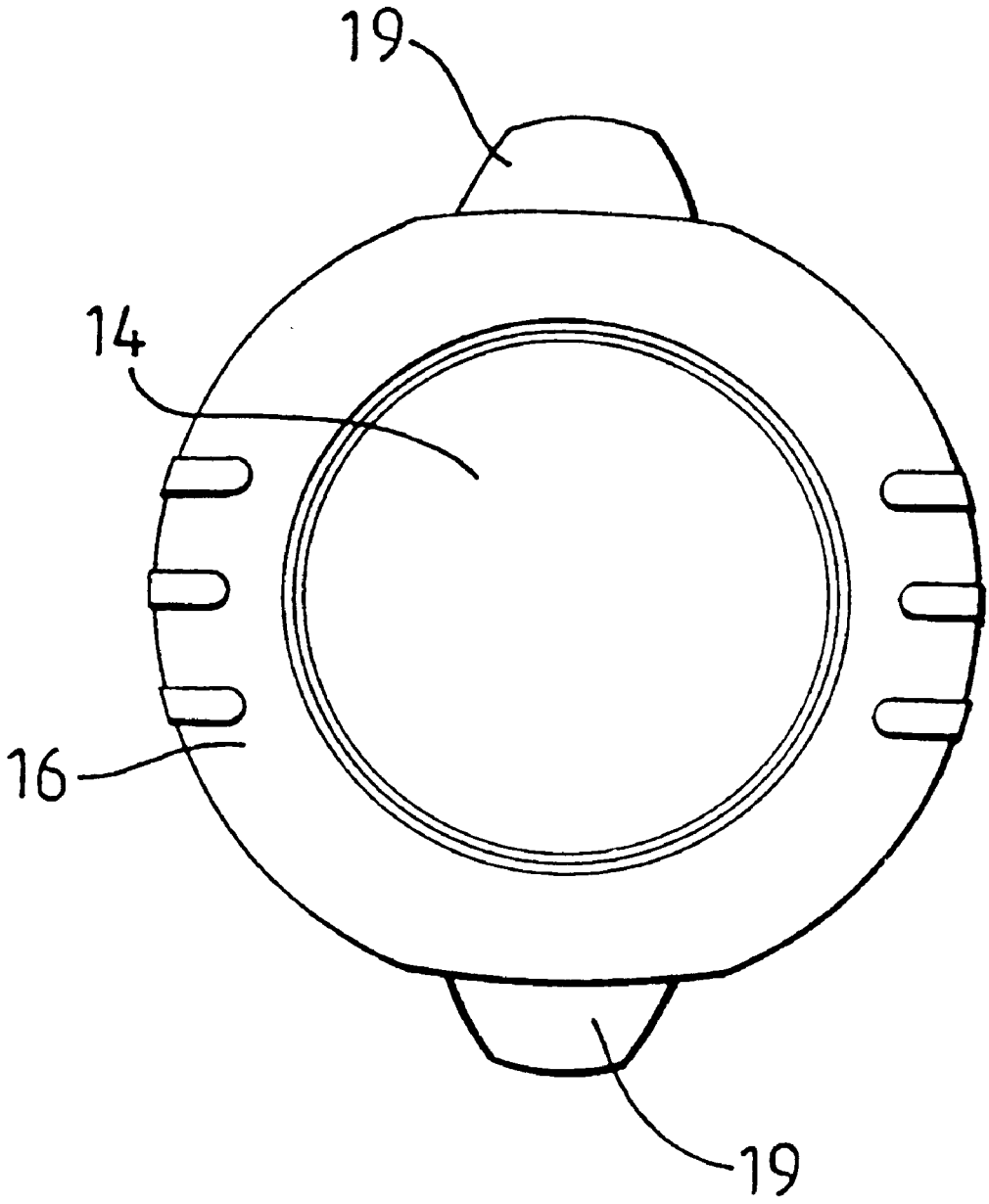
FIG. 9 is a plan view of the top casing part and push buttons.

As illustrated in FIGS. 1A, 1B, and 1C, a foil cutter 12 comprises a substantially rigid annular casing 13 having an axial passage 14 therethrough sized to easily but closely receive the neck of a wine bottle. The casing defines a substantially closed structure apart from the axial passage 14 and apertures 15 on opposite sides thereof for locating push buttons 19 extending through the apertures to the exterior of the casing. The casing is formed in two parts 16, 17 which are a snap-fit together and is of generally circular shape in plan view with the push buttons also rounded to fit the shape. The base 18 of the bottom casing part 17 is flat and the diameter is greater than three times the height of the casing so that the foil cutter can act as a stable support structure for a corkscrew assembly indicated at 20. The corkscrew assembly is separable from the foil cutter and has arms 21 the lower portions of which are sized to be a retaining fit (e.g. an easily separated push fit) in the passage 14 of the foil cutter. The foil cutter thus acts as a stand for the corkscrew assembly upstanding therefrom.

A pair of cutting wheels 22 each having a circular cutting edge 23, is mounted for rotation about respective axes parallel to the axis 24 of the passage 14. The cutting edges extend into the passage 14 on opposite sides thereof. Each cutting member is mounted on a respective push member 25 moulded from flexible plastics material and incorporating a mounting for the cutting member 22, the push button 19, a mounting part 26 and a wing 27 forming a biasing means. Each mounting means 26 defines a bore 28 which is located on an upstanding pin 30 incorporated in the moulding of the lower casing part 17. The arrangement is such that when a push button 19 is pressed inwardly of the casing, to move the cutting edge 23 of its associated cutting member against the neck of a bottle in the passage 14, the mounting 26 pivots about its pin 30 and causes the wing 27 to be bent. The spring in the material of wing 27 acts as a biasing means tending to restore the push member to its rest position shown in FIG. 2.

In use the foil cutter is located over the neck of a bottle, the push buttons 16 are pressed inwardly until the cutting edges 23 engage the neck of the bottle and the foil cutter is then rotated through at least 180° relative to the bottle to cut the foil. As soon as the push buttons are released the biasing means act to move the cutting edges outwards so that the foil cutter can easily be lifted from the neck of the bottle.

The foil cutter preferably incorporates a crown cap opener 35 as seen in FIGS. 6 and 7. The opener 35 is in the form of a disc having an aperture 36 formed with two inwardly tapered projections 37 each having a flat edge. The outer edge of the disc is formed with two opposite cut-outs 38. The lower surface 18 of the lower casing part 17 is formed with a recess 40 adapted to just accommodate the disc 35. Projections 41 extending into this recess can pass through the cut-outs 38 and when the disc is rotated from the position in which the cut-outs are aligned with the projections 41 the crown cap opener will be retained in the recess 40.

As seen in FIG. 8 the upper casing part 16 is formed with a plurality of downwardly extending projections 42 each of which is flexible and has an outwardly extending detent 43. The detents are designed to lock behind parts on the lower casing part when the casing parts are pressed together so that the casing parts snap-fit together. The casing parts may be welded, glued or otherwise connected.

In an alternative arrangement shown in FIG. 10 a plastics material guide-wheel 50 is rotatably mounted on a push button 16A and two cutting wheels 51, 52 are mounted at fixed positions so that each has a cutting edge extending into the passage (14). The cutting wheels 51,52 and guide-wheel 50 are equiangularly spaced from one another. Inward movement of the push button 16A against the biasing means formed by flexible wings 27A causes the guide-wheel to press a bottle neck located in the passage 14 against the cutting edges of the cutting wheels and the foil cutter is then rotated about the bottle neck.

In the alternative arrangement of FIG. 11 there are two opposite cutting wheels 53, 54 but one is fixed and the other located on a push button 16A. In the alternative arrangement of FIG. 12 there are again two opposite cutting wheels (22), each movable, but located on push buttons 16A similar to those of FIGS. 10 and 11.

What is claimed is:

1. In combination a foil cutter in the form of an annulus defining a passage therethrough and a corkscrew assembly, wherein the corkscrew assembly is separable from the foil cutter and has arms pivotable towards and away from one another, the arms having lower ends which are tapered, the lower ends being configured to fit in the passage of the foil cutter, whereby the foil cutter acts as a stand from which the corkscrew assembly may be supported in an upright disposition.

2. A combination according to claim 1 wherein the foil cutter comprises an annular casing having a passage extending axially therethrough and adapted to accommodate the neck of a wine bottle, and a pair of cutting members having cutting edges mounted in the casing so that each extends or is movable to extend into the passage in a plane normal to the axis, one or more of the cutting members being aligned therewith being movable radially inwardly of the passage so as to ensure that both cutting edges engage a bottle neck located in the passage, wherein the casing is substantially rigid, and for each movable cutting member a push member is mounted to the casing extending to the outside of the casing for pressing the associated movable member inwardly of the casing, and having a biasing means for resisting such inward movement.

3. A combination according to claim 2 wherein the casing is of substantially circular shape in plan view.

4. A combination according to claim 2 wherein there are two cutting members movably mounted on opposite sides of the passage and two push members respectively connected thereto and extending from opposite sides of the casing for pushing the cutting members inwardly.

5. A combination according to claim 2 wherein each push member and biasing means comprises a single element molded from flexible material.

6. A combination according to claim 2, wherein each push member comprises a push button part and a wing part, the push button part being mounted to the casing so that inward movement causes the wing part to flex from its rest position and act as a biasing means to restore the push button to its outwardly extending rest position.

7. A combination according to claim 2 wherein each push member is pivotally mounted on a vertically extending pin on the casing.

8. A combination according to claim 2 wherein each cutting member comprises a cutting wheel rotatably mounted about an axis parallel to the axis of the passage.

9. A combination according to claim 2 wherein the cutting members are fixed and a guide member is movable into the passage to urge a bottle neck located in the passage against the cutting members.

10. A combination according to claim 3, wherein the casing is formed in two parts, an upper part and a lower part, said upper part and said lower part being a snap-fit together.

11. A combination according to claim 1 further comprising a crown cap opener forming a part of the foil cutter and having an edge.

12. A foil cutter comprising an annular casing having an axis and a passage extending axially therethrough and adapted to accommodate the neck of a wine bottle, and a pair of cutting members having cutting edges mounted in the casing so that each extends or is movable to extend into the passage in a plane normal to the axis, one or more of the cutting members aligned therewith being movable radially inwardly of the passage so as to ensure that both cutting edges engage a bottle neck located in the passage, wherein the casing is substantially rigid, and for each cutting member a push member mounted to the casing and extending to the outside of the casing for pressing the associated movable member inwardly of the casing, and biasing means for resisting such inward movement wherein each push member and biasing means includes a single element molded from flexible material, wherein each push member comprises a push button part and a wing part, the push button part being mounted to the casing so that inward movement causes the wing part to flex from its rest position and act as a biasing means to restore the push button to its outwardly extending rest position.

* * * * *